US005299515A

United States Patent [19]

Baba et al.

[11] Patent Number: 5,299,515

[45] Date of Patent: Apr. 5, 1994

[54] TOWEL CLOTH POSITIONING DEVICE

[75] Inventors: Nobuo Baba; Toshiyuki Kaneto; Yasuhiro Nagayama, all of Tochigi, Japan

[73] Assignee: The Singer Co N.V., Curacao, Netherlands

[21] Appl. No.: 997,001

[22] Filed: Dec. 28, 1992

[30] Foreign Application Priority Data

Mar. 17, 1992 [JP] Japan ..... 4-022489[U]

[51] Int. Cl.[5] ..... D05B 35/02

[52] U.S. Cl. ..... 112/141; 112/130; 112/121.25

[58] Field of Search ..... 33/286, 276, 645; 356/399, 401, 400; 362/90; 112/121.25, 141, 136, 153, 130, 320, 235, 114, 104, 147; 83/520, 902; 271/226, 241, 255

[56] References Cited

U.S. PATENT DOCUMENTS 1,804,764 5/1931 Grant ..... 83/520 X
2,806,492 9/1957 Becker ..... 83/520
4,754,717 7/1988 Henze et al. ..... 112/10
5,052,316 10/1991 Sakakibara ..... 112/104 X

*Primary Examiner*—Clifford D. Crowder
*Assistant Examiner*—Paul C. Lewis

[57] ABSTRACT

A towel cloth positioning device comprises a plurality of projectors provided above a work table for projecting indication marks on the hemming portion of a sheet of towel cloth which is cut piece by piece and is placed on the work table so as to indicate given positions on the hemming portion thereof and pressing units for pressing the towel cloth at the hemming portion thereof on the work table by way of pressing members capable of individually pressing the hemming portion of the towel cloth. Inasmuch as the edge of the hemming portion of the towel cloth can be accurately cut at the edge thereof, it is possible to effectively produce a high quality towel. Moreover, inasmuch as the positioning according to the positioning patterns is performed a plurality of times, it is possible to place various kinds of towel cloths along a line indicated by the positioning patterns with ease and accuracy.

1 Claim, 7 Drawing Sheets

TOWEL CLOTH POSITIONING DEVICE

BACKGROUND OF THE INVENTION

1. Field of the Invention:

The present invention relates to a semi-automatic device for towel hemming which successively performs the folding and sewing of the hemming portion of a towel cloth after the same is placed on a work table manually piece by piece and is cut at the edge of the hemming portion thereof, particularly to a towel cloth positioning device for use in the process of cutting the edge of the hemming portion of the towel cloth prior to the folding process.

2. Description of the Related Art:

A conventional semi-automatic sewing device for towel hemming of this kind is disclosed in Japanese Patent No. 63-15872. In the semi-automatic sewing device for towel hemming, a towel cloth cut off piece by piece by a cutter unit for a predetermined length from a towel material of long size is manually placed on a work table (in a towel cloth positioning area), thereafter is transported to a folding process area by a conveying means, and is further transported to a sewing process area by another conveying means so as to be sewn at the hemming portion thereof by a sewing unit after the completion of folding operation of the hemming portion.

In the conventional semi-automatic sewing device for towel hemming, however, curved creases due to the shrinkage of fibers or frayed fibers are liable to appear about the hemming portion of a sheet of towel cloth, resulting in the appearance of the fiber ends there, in case of a high quality towel which individually needs dying by several kinds of dyestuffs, water washing and drying after cutting, so that manual trimming is performed in advance. Furthermore, a very high quality towel further requires such a troublesome work as manually sewing the threefold hemming portion in a sewing factory. As a result, the development of a towel positioning unit of the semi-automatic sewing device for towel hemming which contributes to the elimination or reduction of labor of such work has been looked for.

SUMMARY OF THE INVENTION

In view of such conventional technical problems in a semi-automatic sewing device for towel hemming, which is provided with a towel positioning area, a folding process area and a sewing process area, which are arranged in this order, the towel cloth positioning device according to the present invention is characterized in comprising a plurality of projectors provided above a work table for projecting indication marks on the hemming portion of a sheet of towel cloth which is cut peace by piece and is placed on the work table so as to indicate given positions on the hemming portion thereof and pressing units for pressing the towel cloth at the hemming portion on the work table by way of a plurality of pressing members capable of individually pressing the hemming portion of a towel cloth.

Moreover, at least one of the plurality of pressing members can be equipped with an auxiliary pressing member for pressing the label on the hemming portion.

As evident from the description set forth above, inasmuch as the edge of the hemming portion of the towel cloth which has been cut off piece by piece in advance is accurately cut again at the towel positioning area of the semi-automatic sewing device for towel hemming according to the present invention, frays or the curved or deformed edges are removed, so that a high quality towel having a threefold hemming of strict sewing quality standard can be efficiently manufactured without manually sewing the hemming portion of the towel cloth so as to contribute to the rationalization of a sewing factory. Moreover, inasmuch as the device includes a plurality of pressing units arranged separately and the towel cloth is positioned by the help of the positioning patterns a plurality of times, it is possible to place a towel cloth which is too loose and soft to be folded neatly along lines indicated by the positioning patterns on the work table with ease and accuracy so as to greatly contribute to the rationalization of work of a sewing factory.

Furthermore, inasmuch as at least one of the pressing units arranged separately is provided with an auxiliary pressing unit which operates independently, it is possible to insert various labels in size into the hemming portion, which is very effective for practical use.

DESCRIPTION OF THE PREFERRED EMBODIMENT

An embodiment of the present invention will be described hereinafter.

FIGS. 1 to 14 show a towel cloth positioning device according to a first embodiment of the present invention.

Figure 3:
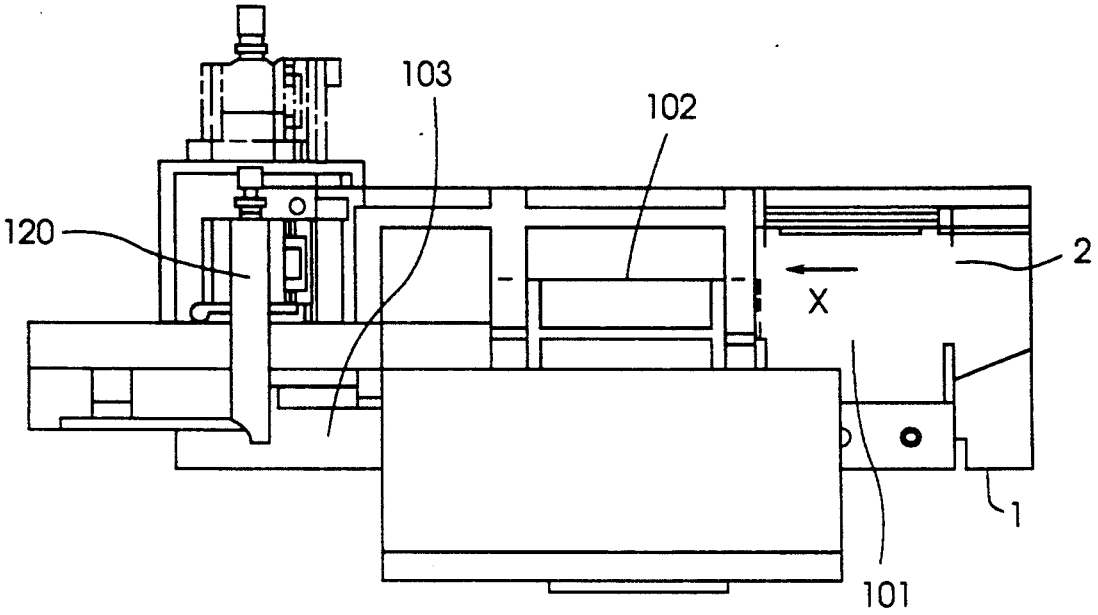
FIG. 3 is a plan view showing the semi-automatic sewing device for towel hemming in FIG. 1.
Figure 4:
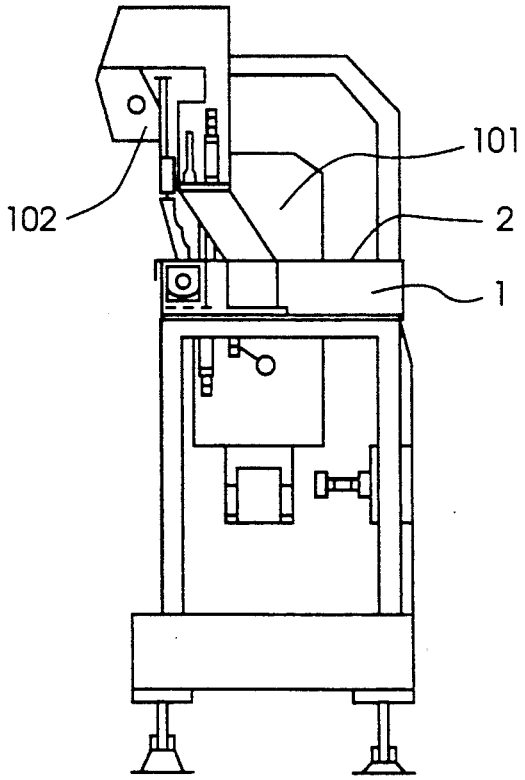
FIG. 4 is a side view showing the semi-automatic sewing device for towel hemming in FIG. 1.

In the figures denoted at 1 is a device frame. On a work table 2 provided in the device frame 1, a towel positioning area 101, a threefold folding process area 102 and a sewing process area 103 are successively arranged in the conveying direction X of a towel cloth A in this order as illustrated in FIGS. 3 and 4. A sheet of towel cloth A, which is cut off from a towel material of long size for a piece of towel, is placed in the towel positioning area 101 so as to be cut off at the edge thereof again as illustrated in FIG. 1.

Figure 1:
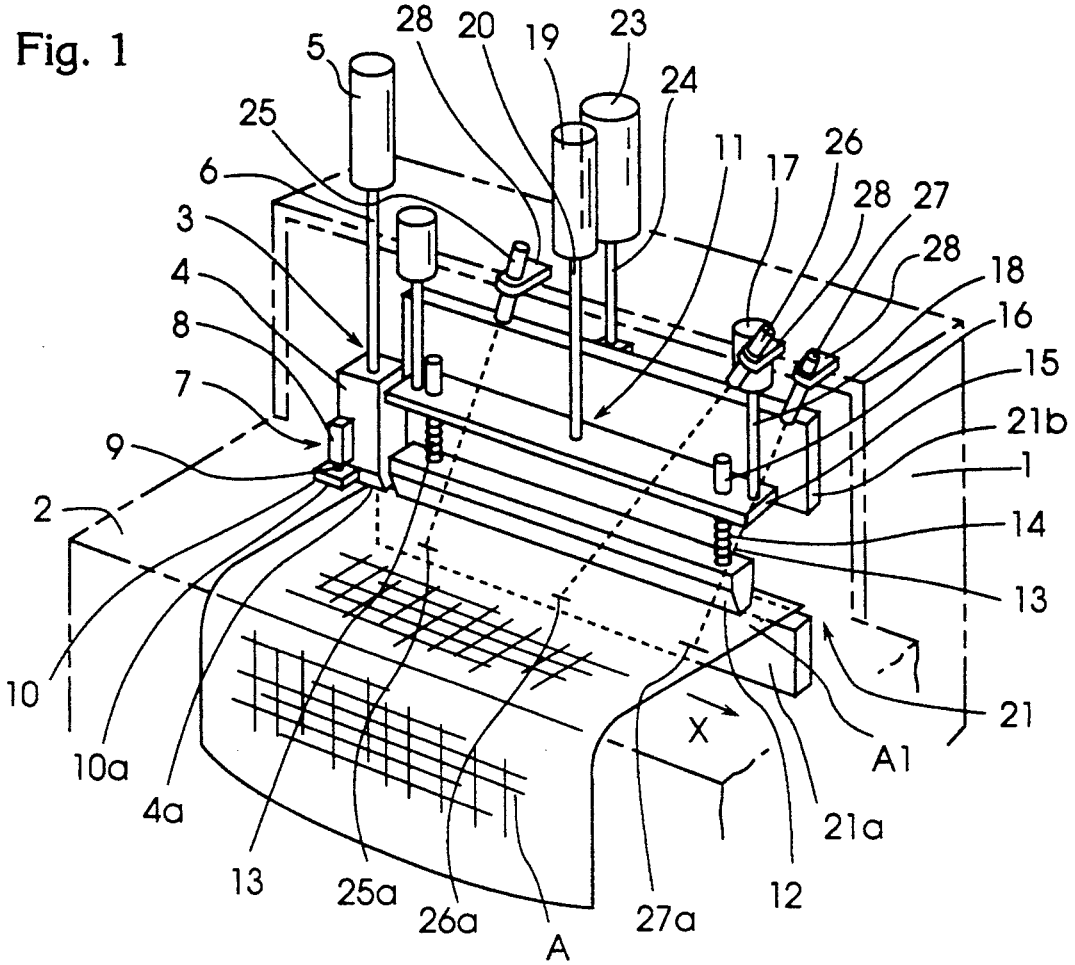
FIG. 1 is a perspective view showing a towel positioning area in a semi-automatic sewing device for towel hemming according to an embodiment of the present invention.

A first pressing unit 3 and a second pressing unit 11 for fixedly pressing the hemming portion A1 of the towel cloth A on the work table 2, a cutter unit 21 and a plurality of (more than three) projectors 25, 26 and 27 are arranged in the towel positioning area 101 as illustrated in FIG. 1.

The first pressing unit 3 includes a first pressing member 4 for fixedly pressing the hemming portion A1 of the towel cloth A placed on the work table 2 leaving a little bit of the edge thereof as it is cut off. That is, the pressing member 4 is coupled to the piston rod 6 of a pneumatic actuator 5 fixed to the device frame 1 so as to lower by the forward operation of the pneumatic actuator 5 so that the lower tip portion 4*a* of the pressing member 4 is pressed on the surface of the towel cloth A.

An auxiliary pressing unit 7 is attached to the first pressing member 4. The auxiliary pressing unit 7 comprises a pneumatic actuator 8 fixed to the first pressing member 4 and an auxiliary pressing member 10 fixed to the tip end of the piston rod 9 of the pneumatic actuator 8. The auxiliary pressing unit 7 presses the auxiliary pressing member 10 on the surface of the towel cloth A by the forward operation of the pneumatic actuator 8. The auxiliary pressing member 10 is arranged adjacent to the first pressing member 4 in the direction perpendicular to the conveying direction X.

Figure 13:
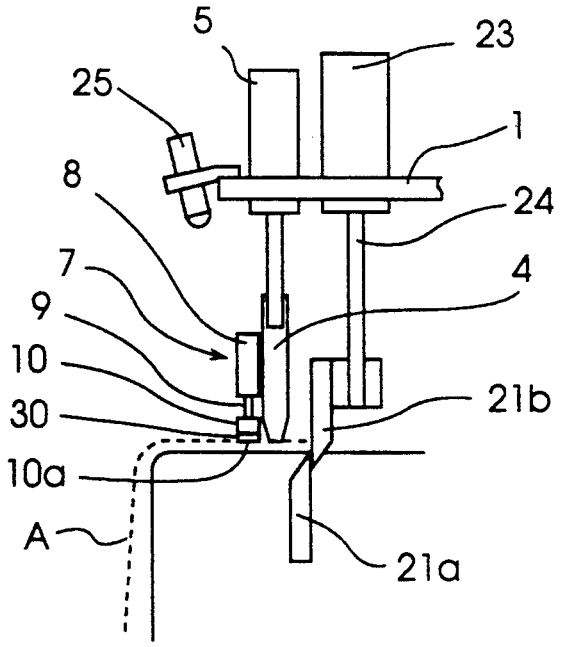
FIG. 13 is a view of assistance for explaining the operation of the first pressing unit equipped with an auxiliary pressing unit in FIG. 1.
Figure 14:
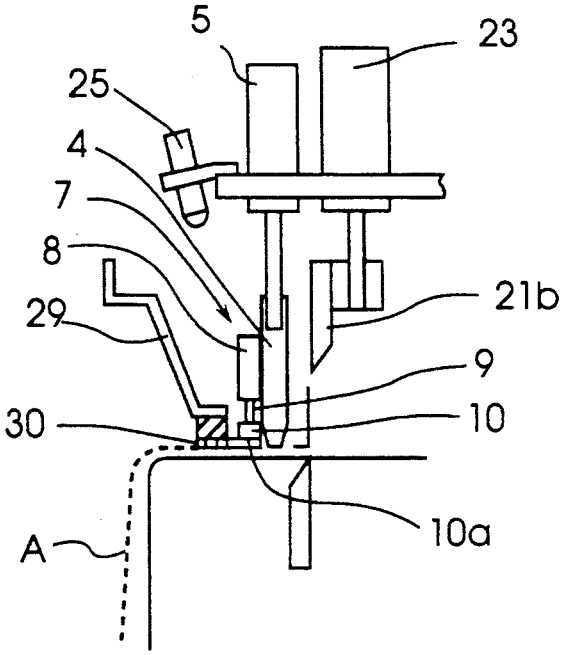
FIG. 14 is a view of assistance for explaining the operation of the first pressing unit equipped with an auxiliary pressing unit in FIG. 1.

Such an auxiliary pressing unit 7 is used for pressing a label 30 (as shown in FIGS. 13 and 14) for indicating a brand name, quality, grade, size, etc. on the threefold portion of the towel cloth when the label 30 is sewn therein. In a state where the pneumatic actuator 8 is operated backward, the lower surface 10*a* of the auxiliary pressing member 10 is not in contact with the towel cloth A even if the first pressing member 4 is pressed thereon. The auxiliary pressing member 10 is brought into contact with the towel cloth A by the forward operation of the pneumatic actuator 8 in a state where the first pressing member 4 is pressed on the towel cloth A.

Figure 5:
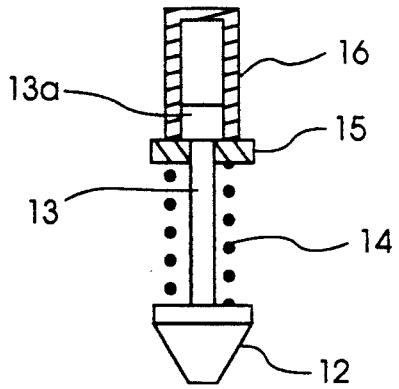
FIG. 5 is a partial cross-sectional view showing a second pressing unit in FIG. 1.

A second auxiliary pressing unit 11 is provided at a position shifted in the conveying direction X from that of the first pressing unit 3. The second pressing unit 11 includes a second pressing member 12 for pressing and fixing the towel cloth A at the hemming portion A1 thereof on the work table 2 leaving a little bit of the edge thereof. The second pressing member 12 has the guide pins 13 projecting upward at both ends thereof, and the guide pins 13 are vertically slidably inserted into a supporting plate 15 and a linear guide 16 provided on the supporting plate 15, being able to be retained by the upper surface of the supporting plate 15 at the head portions 13*a* of the guide pins 13 at the maximum projecting position, while the pressing member 12 is pushed down by a spring 14 interposed between the supporting plate 15 and the pressing member 12 as illustrated in FIG. 5.

The supporting plate 15 is vertically slidably supported by the device frame 1 by slidably inserting guide pins 18 projecting upright at the both end thereof into a pair of linear guides 17 provided on the device frame 1. The linear guides 17 may have substantially the same structure as that of the linear guides 16 set forth above. The central portion of the supporting plate 15 is connected to a piston rod 20 of a double action pneumatic actuator 19 fixed on the device frame 1, so that it is possible to lower the supporting plate 15 so as to bring the second pressing member 12 connected thereto by way of the spring 14 into an elastic contact with the towel cloth A by the forward operation of the pneumatic actuator 19.

The cutter unit 21 comprises a fixed cutter 21*a* fixed to the work table 2 and a vertically driven movable cutter 21*b*. The movable cutter 21*b* fixed to the piston rod 24 of a double action pneumatic actuator 23 fixed to the device frame 1 is lowered by the forward operation of the pneumatic actuator 23 so as to cut the towel cloth A at the hemming portion A1 thereof cooperating with the fixed cutter 21*a*.

Figure 2:
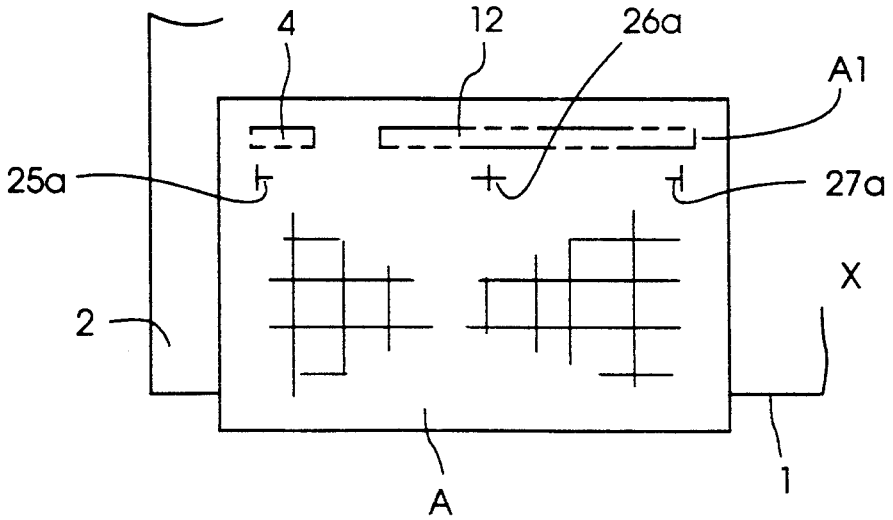
FIG. 2 is a view showing the arrangement of a work table in FIG. 1.

A plurality of projectors 25, 26 and 27 mounted on the device frame 1 respectively by way of brackets 28 thereof are positioned above the work table 2, concretely above the supporting plate 15. The projectors 25, 26 and 27 project positioning patterns (indication marks) 25*a*, 26*a* and 27*a* respectively at a given interval on a line extending in the conveying direction X of the towel cloth A for accurately indicating given positions on the hemming portion A1 in the towel cloth A placed on the work table 2 as shown in FIG. 2.

Figure 9:
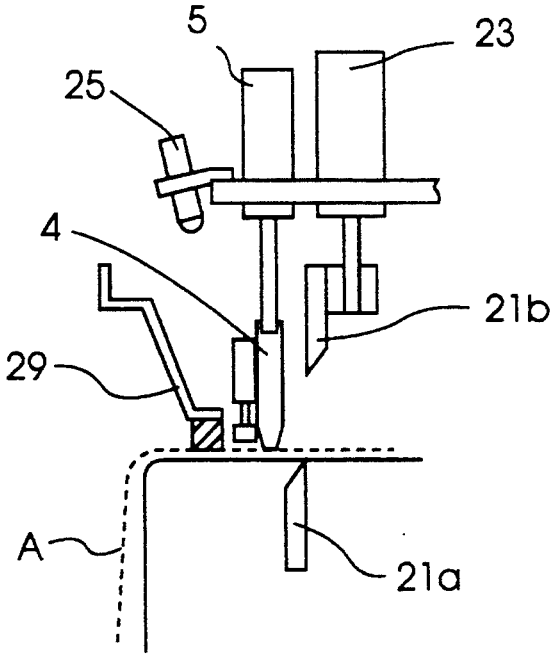
FIG. 9 is a view of assistance for explaining the operation of the first pressing unit FIG. 1.
Figure 12:
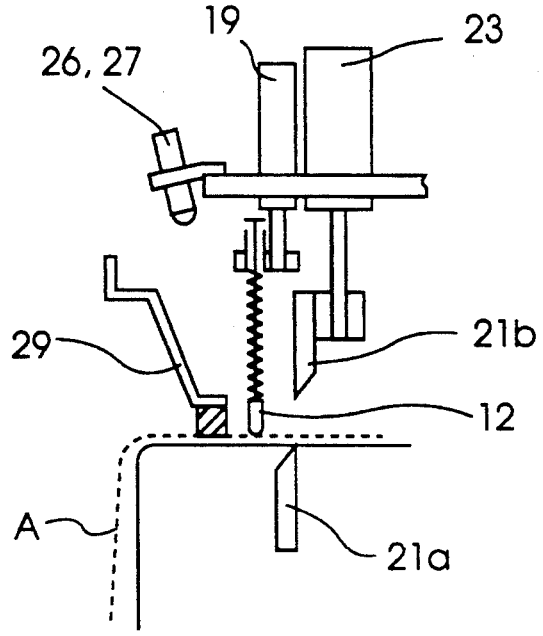
FIG. 12 is a view of assistance for explaining the operation of the second pressing unit FIG. 1.

The towel cloth A is transported from the towel positioning area 101 to the threefold folding process area 102 by a conveying means such as a belt etc., not shown, while being pressed by a pressing member 29 for conveyance as illustrated in FIGS. 9 and 12. The threefold folding process area 102 has a known structure in which the hemming portion A1 in the towel cloth A is folded twice so as to form a threefold hemming portion A2.

The threefold folding process area 102, as disclosed in e.g. Japanese Patent Publication No. 1-299164, comprises a guide ruler which presses the hemming portion A1 in a sheet of towel cloth A between the work table 2 and itself to regulate the folding edge and is advanced after each folding to get out of the folded portion, an upper presser which is disposed under the hemming portion A1 in the towel cloth A pressed by the guide ruler and is raised and thereafter advanced to fold the hemming portion A1 for the first time, and a lower presser which is supported by a holder integrally formed with the upper presser so as to be slidable forward and rearward, and is disposed under the upper presser for folding the hemming portion A1 for the second time and thereafter the folded hemming portion A1 is pressed upon the work table 2 by the lower presser.

The sewing unit of the sewing process area 103 is mainly composed of an industrial sewing machine 120 in which a cloth feeding unit is omitted, for sewing the threefold hemming portion A1 of the towel cloth A conveyed from the threefold folding process area 102 while being clamped by a clamping unit, not shown.

A function of the towel positioning area 101 of the embodiment set forth above will be described hereinafter.

Figure 10:
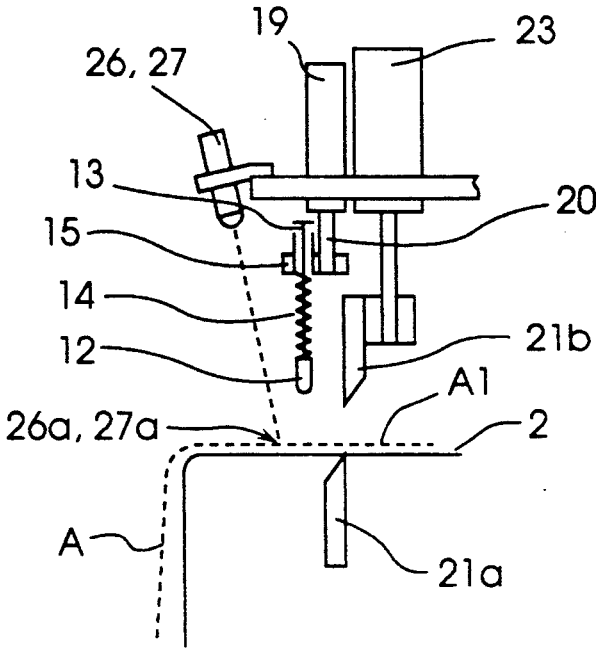
FIG. 10 is a view of assistance for explaining the operation of the second pressing unit FIG. 1.
Figure 11:
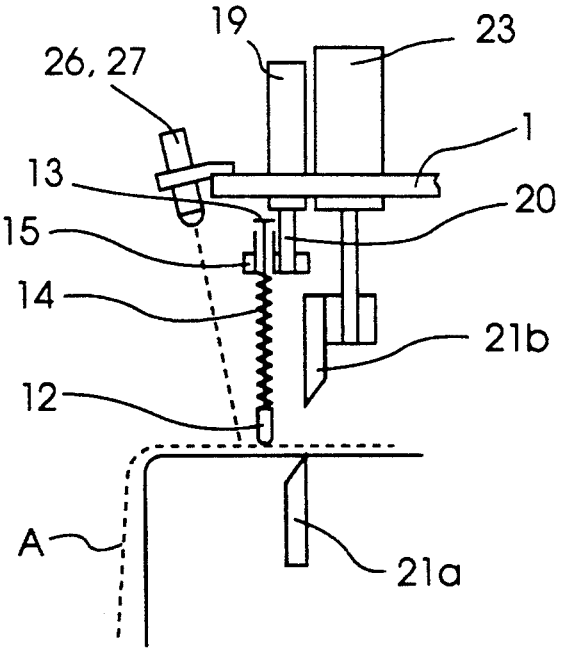
FIG. 11 is a view of assistance for explaining the operation of the second pressing unit FIG. 1.

FIGS. 6 to 9 are views of assistance for explaining the operation of the first pressing unit 3, while FIGS. 10 to 12 are views of assistance for explaining the operation of the second pressing unit 11, wherein the auxiliary pressing unit 7 is not used.

Figure 6:
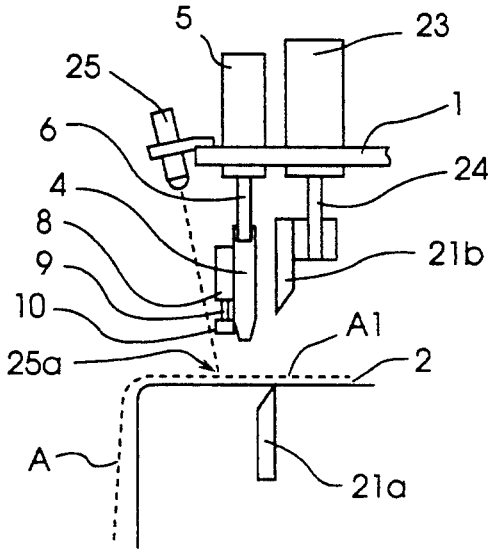
FIG. 6 is a view of assistance for explaining the operation of a first pressing unit in FIG. 1.

At first, the operation of the pressing units 3 and 11 will be described with reference to FIGS. 6 and 10 respectively.

The first pressing member 4 is returned to its upper home position by the backward operation of the pneumatic actuator 5. The second pressing member 12 is returned to its upper home position by the backward operation of the pneumatic actuator 19, while the movable cutter 21*b* is separated upward from the fixed cutter 21*a* by the backward operation of the pneumatic actuator 23.

At this state, the towel cloth A is placed on the work table 2 piece by piece. A sheet of towel cloth A, which is cut off piece by piece from the towel material of long size for manufacturing a high quality towel, is thereafter individually subjected to the dying by various kinds of dyestuffs, water washing and drying, which cause the appearance of curved creases due to the shrinking of fibers or frayed fibers about the cut end portion of the towel cloth A.

In this stage an operator performs an accurate positioning of the towel cloth A according to a positioning pattern 25*a* projected on the hemming portion A1 of the towel cloth A adjacent to the first pressing unit 3 as illustrated in FIG. 2. Accurate positioning according to other positioning patterns 26*a* and 27*a* are performed in later stages.

Figure 7:
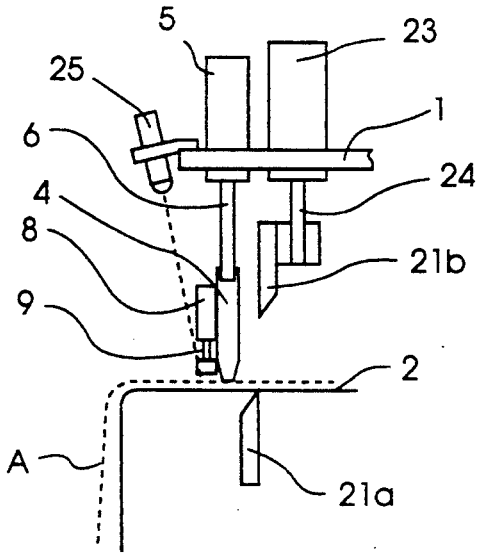
FIG. 7 is a view of assistance for explaining the operation of the first pressing unit FIG. 1.

FIG. 7 shows a state of the positioning device where an operator starts the semi-automatic sewing device for towel hemming by pushing a start button (not shown) and where the first pressing member 4 is lowered by the forward operation of the pneumatic actuator 5 so that it is in contact with the surface of the towel cloth A.

In this stage, the pneumatic actuator 19 of the second pressing unit 11 is in the position of the backward operation and the second pressing member 12 is not in contact with the surface of the towel cloth A.

Thereafter the operator performs the accurate positioning of other portions of the towel cloth A according to other positioning patterns 26*a* and 27*a* projected on the hemming portion A1 of the towel cloth A.

Referring to FIG. 11, the pneumatic actuator 19 is operated forward to lower the supporting plate 15, so that the second pressing member 12 connected to the supporting plate 15 by way of the linear guide 16 and the guide pins 13 is brought into contact with the surface of the towel cloth A. The supporting plate 15 is stopped at a given position because it would continue to lower against the resilience of the spring 14.

The hemming portion A1 of the towel cloth A is pressed by the first pressing unit 3 at a position adjacent to a positioning pattern 25*a* and is pressed by the second pressing unit 11 at the positions adjacent to other positioning patterns 26*a* and 27*a* respectively and elastically. In this way, inasmuch as the positioning operation of the hemming portion A1 of the towel cloth A is performed separately by the first and second pressing units 3 and 11, the number of the positioning patterns 25*a*, 26*a* and 27*a* to which the operator has to pay attention at a time is reduced. As a result, accurate positioning according to all the positioning patterns 25*a*, 26*a* and 27*a* is improved in efficiency particularly in a soft and loose towel cloth A.

Figure 8:
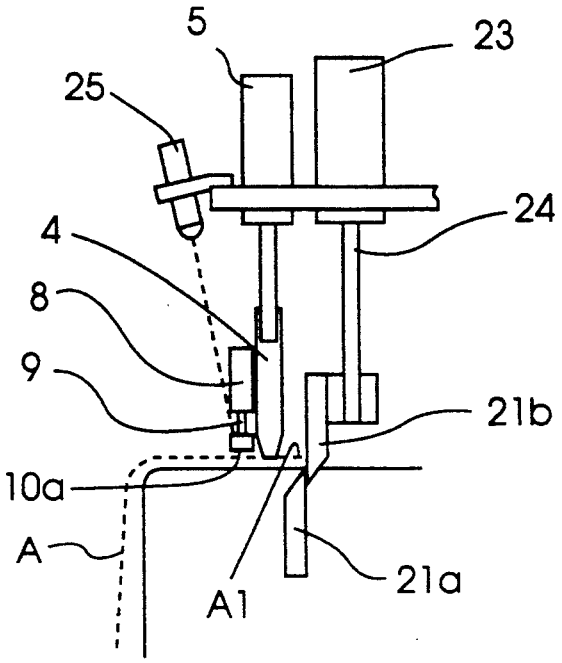
FIG. 8 is a view of assistance for explaining the operation of the first pressing unit FIG. 1.

Referring to FIG. 8, the movable cutter 21*b* is lowered by the forward operation of the pneumatic actuator 23 so as to cut the edge of the hemming portion A1 of the towel cloth A at the overall width thereof cooperating with the fixed cutter 21*a*.

Referring to FIGS. 9 and 12, the pneumatic actuator 23 is operated backward to return the movable cutter 21*b* to its upper home position. At that time, the pneumatic actuators 5 and 19 are kept extended so as to press the hemming portion A1 in the towel A with the first pressing member 4 and the second pressing member 12.

A pressing member 29 for conveyance presses the towel cloth A which has been cut at the edge of the hemming portion A1 thereof so as to transfer the same to the threefold folding process area 102.

In next stage, the first pressing member 4 and the second pressing member 12 are raised to their home positions by the backward operation of the pneumatic actuators 5 and 19 and the towel cloth A is transported to the threefold folding process area 102 for being subjected to the folding process and then to the sewing process.

A series of processes set forth above are successively repeated so as to perform the semi-automatic sewing of the hemming portion A1 in the towel cloth A.

An operation of the auxiliary pressing unit 7 will be described hereinafter with reference to FIGS. 1, 13 and 14.

In case of using the auxiliary pressing unit 7, an operator inserts a label 30 under the auxiliary pressing member 10. That is, the operator inserts the label 30 under the auxiliary pressing member 10 after the stage as illustrated in FIGS. 7 and 11, i.e., after the towel cloth A is pressed by the first pressing unit 3 and the second pressing unit 11.

FIG. 13 shows a state where the pneumatic actuator 8 is operated forward so as to lower the piston rod 9 so that the label 30 is pressed on the surface of the towel cloth A by the lower end surface 10*a* of the auxiliary pressing member 10 fixed to the tip end of the piston rod 9 and the pneumatic actuator 23 is operated forward to lower the movable cutter 21*b* so as to cut the towel cloth A at the edge of the hemming portion A1 thereof cooperating with the fixed cutter 21*a*.

FIG. 14 shows a state where the movable cutter 21*b* is returned to its upper home position by the backward operation of the pneumatic actuator 23, the first pressing member 4 is pressing on the towel cloth A and the label 30 is pressed on the upper surface of the towel cloth A. The second pressing member 12 is pressing on the towel cloth A in the same way as illustrated in FIG. 12.

The label 30 and the towel cloth A which has been cut at the edge of the hemming portion A1 thereof are pressed by the pressing member 29 for conveyance so as to be transported to the threefold folding process area 102.

In next stage, the first pressing member 4 and the second pressing member 12 are raised respectively, and the label 30 is transported to the threefold folding process area 102 together with the towel cloth A, where the label is folded in the threehold hemming portion of the towel cloth A so as to be subjected to sewing. The auxiliary pressing unit 7 attached to the first pressing member 4 is raised accompanying the rise of the first pressing member 4 and thereafter is returned to its home position by the backward operation of the pneumatic actuator 8.

A series of processes set forth above are successively repeated so as to perform the semi-automatic sewing of the hemming portion A1 of a labeled towel.

Although the auxiliary pressing unit 7 is attached to the first pressing member 4 according to the embodiment set forth above, it is also possible to attach the auxiliary pressing unit 7 to the second pressing unit 11, and it is also possible to fix the pneumatic actuator 8 of the auxiliary pressing unit 7 to the device frame 1.

The operation of such a semi-automatic sewing device for towel hemming in the towel positioning area is as follows. At first, a sheet of towel cloth A, which is cut off piece by piece from the towel material of long size for manufacturing, e.g., a high quality towel, is individually subjected to the dying by dyestuffs, water washing and drying, which cause the appearance of curved creases due to the shrinking of fibers or frayed fibers about the cut end portion of the towel cloth. The towel cloth A of this state is placed on the work table 2 piece by piece. At that time, the hemming portion of the towel cloth is placed on the work table according to the indication marks projected by each projector.

A given position of the towel cloth is set to an indication mark, then the towel cloth is pressed by an adjacent pressing member so as to be accurately fixed at a part of the hemming portion of the towel cloth. After the part of the towel cloth is fixed, other given positions of the hemming portion of the towel are set to other indication marks accurately, and the towel cloth is pressed by other pressing members so as to be accurately fixed at all the hemming portion of the towel cloth. In this way, the hemming portion of the towel cloth is accurately placed on the work table step by step according to the indication marks projected by all the projectors serving as a successive indices. Thereafter the movable cutter is lowered so as to cut the edge portion of the towel cloth at the edge thereof cooperating with the fixed cutter.

Consequently, the edge of the hemming portion of the towel cloth is cut in a straight line. As a result, frayed fiber ends are prevented from appearing adjacent to the inner edge of the threefold hemming portion formed at the edge portion of the towel cloth when the same is finished as a high quality towel through the succeeding folding process area and sewing process area, so that a threefold hemming portion of high quality can be efficiently manufactured.

Moreover, in case that an auxiliary pressing unit provided with an auxiliary pressing member for pressing a label on the towel cloth is attached to at least one of a plurality of pressing units, it is possible to accurately place the hemming portion of the towel cloth on the work table according to the indication marks projected by all the projectors and further more it is possible to fixedly press a label on the hemming portion of the towel cloth by the auxiliary pressing unit. At this state the towel cloth is cut at the edge of the hemming portion thereof and thereafter is transported to the folding process area and then to the sewing process area.

What is claimed is:

1. In combination with a system wherein a towel cloth cut off piece by piece to a predetermined length from a towel cloth of long size by a first cutter unit has an edge with fiber ends which display frays or curved or deformed edges and wherein this edge must be accurately hemmed, the towel cloth being placed upon a work table with said edge exposed, a towel cloth positioning device comprising:

a second cutter unit at the work table for again cutting the previously cut edge of the cloth to remove said fiber ends;

a plurality of projectors disposed above the cloth at the work table to project indication marks constituting positioning patterns onto the cloth adjacent the again cut edge;

means to successively position, fold and press the cloth in accordance with said patterns to produce a towel having a portion to be hemmed; and means to hem said portion of the cloth.

* * * * *